US006416172B2

(12) United States Patent
Jeong et al.

(10) Patent No.: US 6,416,172 B2
(45) Date of Patent: Jul. 9, 2002

(54) INK-JET HEAD DEVICE WITH A MULTI-STACKED PZT ACTUATOR

(75) Inventors: Hee Moon Jeong; Suk Han Lee; Yong-soo Oh, all of Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/756,705

(22) Filed: Jan. 10, 2001

(30) Foreign Application Priority Data

Jan. 11, 2000 (KR) ..... 00-1192
Jan. 11, 2000 (KR) ..... 00-1193

(51) Int. Cl.[7] ..... B41J 2/045
(52) U.S. Cl. ..... 347/72; 347/68
(58) Field of Search ..... 347/68, 71, 72

(56) References Cited

U.S. PATENT DOCUMENTS 4,395,719 A 7/1983 Majewski ..... 346/140
5,581,288 A * 12/1996 Shimizu et al. ..... 347/87
5,825,386 A 10/1998 Ohashi ..... 347/71
5,838,350 A * 11/1998 Newcombe et al. ..... 347/68

FOREIGN PATENT DOCUMENTS

EP 0693379 2/1996
JP 0404945 2/1992

* cited by examiner

*Primary Examiner*—Thinh Nguyen
(74) *Attorney, Agent, or Firm*—Lee & Sterba, P.C.

(57) ABSTRACT

An ink-jet head device using a stack of piezoelectric bodies, including a nozzle plate having a nozzle, a manifold portion having a restrictor plate that has a restrictor, piezoelectric bodies stacked in multiple layers and interposed between the nozzle plate and the manifold portion to form a chamber for containing ink, each of the piezoelectric bodies having a cavity at the center, common electrodes and driving electrodes alternately interposed one by one between adjacent piezoelectric bodies, a common lead line and a driving line electrically connected to the common electrodes and driving electrodes, respectively, for supplying a voltage to piezoelectric bodies to cause deformation thereof, and a medium interposed at least between the restrictor plate and a piezoelectric body adjacent to the restrictor plate, and between the nozzle plate and a piezoelectric body adjacent to the nozzle plate, the medium deformed corresponding to deformation of the piezoelectric bodies.

29 Claims, 13 Drawing Sheets

INK-JET HEAD DEVICE WITH A MULTI-STACKED PZT ACTUATOR

BACKGROUND OF THE INVENTION

1. Field of the Invention

The present invention relates to an ink-jet head device using a piezoelectric (PZT) actuator.

2. Description of the Related Art

Existing types of ink-jet printing methods used by drop on-demand systems include an electro-thermal transduction method and an electro-mechanical transduction method using a piezoelectric body.

In an electro-thermal transduction method, a heat source generates bubbles in ink, and the force of the bubbles discharges the ink. Thus, the performance of discharge depends on the ingredients of ink.

In an electro-mechanical transduction method using a piezoelectric body, discharge of ink can be achieved using a volume change caused by the deformation of a piezoelectric body. Thus, this method has few restrictions on the type of ink used compared to the electro-thermal transduction method. In addition, an ink-jet head device adopting this method is durable.

An ink-jet head device using a piezoelectric body is roughly made up of a chamber in which ink supplied from an ink supplier is contained, a piezoelectric actuator for changing the volume of the chamber to drive ink to be ejected, a nozzle having ink discharge holes, and driving electrodes.

The ink-jet head devices using a piezoelectric body are roughly classified into three categories: a device using a bending method, a device using a pushing method, and a device using a shear deformation method.

European Patent No. 0864425A1, for example, discloses a bending-type ink-jet head device. This bending-type ink-jet head device has a structure in which a piezoelectric body deformed by voltage is formed on a vibrating plate. In this bending-type ink-jet head device, the vibrating plate is also bent when the piezoelectric body is bent, because of the structural characteristics of the vibrating plate and the piezoelectric body. This action causes a volume change of an ink chamber which adjoins to the vibrating plate, and a change in the inside pressure of the ink chamber. A change in the volume of the chamber is required to discharge the ink, and the pressure of the chamber is needed to control the discharge performance of the ink drop. This bending-type ink-jet head device having such a structure has a trade-off between the volume change of the chamber and the pressure thereof, resulting in a limit in designing.

A pushing-type ink-jet head device is disclosed in U.S. Pat. No. 5,424,769, for example. In this device, pushing a vibrating plate using the deformation of a piezoelectric body changes the volume of a chamber. In this structure, when the vibrating plate is reduced in size to obtain a high resolution, it must be greatly deformed in order to obtain a change in the volume of the chamber.

This large deformation exerts excessive stress on the vibrating plate, often causing the vibrating plate to fail.

In a device disclosed in U.S. Pat. No. 4,395,719, for example, a piezoelectric body is designed in a tube structure, and the interior space of the tube-typed piezoelectric body is directly used as a chamber, so that a vibrating plate generates no problems. However, this device must use a flexible rubber piezoelectric body. In this case, the chamber is easily deformed, but its performance is degraded for lack of a force to discharge ink.

SUMMARY OF THE INVENTION

In order to solve the aforementioned problems, it is a feature of an embodiment of the present invention to provide an ink-jet head device using a piezoelectric actuator, which has an increased ink discharge capability.

It is another feature of an embodiment of the present invention to provide an ink-jet head device using a piezoelectric actuator, which has a high ink discharge capability even at a low voltage.

In an effort to satisfy these and other features of the embodiments of the present invention there is provided an ink-jet head device using a stacked piezoelectric actuator, including: a nozzle plate on which at least one nozzle is formed; a manifold portion having a restrictor plate on which at least one restrictor is formed; a plurality of piezoelectric bodies stacked in multiple layers and interposed between the nozzle plate and the manifold portion to form a chamber for containing ink, each of the piezoelectric bodies having a cavity at the center; common electrodes and driving electrodes alternately interposed one by one between adjacent piezoelectric bodies; a common lead line and a driving line electrically connected to the plurality of the common electrodes and the plurality of driving electrodes, respectively, for supplying a voltage to the plurality of piezoelectric bodies to cause deformation thereof; and a medium interposed at least between the restrictor plate and a piezoelectric body adjacent to the restrictor plate, and between the nozzle plate and a piezoelectric body adjacent to the nozzle plate, the medium deformed corresponding to deformation of the piezoelectric bodies.

In an additional effort to achieve the above features of an embodiment of the present invention there is provided an ink-jet head device using a stacked piezoelectric actuator, including: a nozzle plate on which at least one nozzle is formed; a manifold portion having a restrictor plate on which at least one restrictor is formed; a piezoelectric body structure interposed between the nozzle plate and the manifold portion, in which cylindrical piezoelectric bodies are stacked, and a chamber for containing ink is provided; common electrodes and driving electrodes alternately interposed one by one between adjacent piezoelectric bodies; a common lead line and a driving line electrically connected to the plurality of the common electrodes and the plurality of driving electrodes, respectively, for supplying a voltage to the plurality of piezoelectric bodies to cause deformation thereof; and a medium interposed between the restrictor plate and one end of the piezoelectric body structure adjacent to the restrictor plate, and between the nozzle plate and the other end of the piezoelectric body structure adjacent to the nozzle plate, the medium deformed corresponding to deformation of the piezoelectric bodies.

In a further effort to achieve the above features of an embodiment of the present invention there is provided an ink-jet head device using a stacked piezoelectric actuator, including: a nozzle plate on which at least one nozzle is formed; a manifold portion having a restrictor plate on which at least one restrictor is formed; a cylindrical medium which is installed between the nozzle plate and the manifold portion, and provides a chamber for containing ink; a piezoelectric body structure installed around the cylindrical medium and separated from the nozzle plate and the manifold portion, in which cylindrical piezoelectric bodies are stacked in multiple layers; common electrodes and driving electrodes alternately interposed one by one between adjacent piezoelectric bodies; and a common lead line and a driving line electrically connected to the plurality of the common electrodes and the plurality of driving electrodes, respectively, for supplying a voltage to the plurality of piezoelectric bodies to cause deformation thereof.

These and other features of the embodiments of the present invention will be readily apparent to those skilled in the art upon review of the detailed description that follows.

BRIEF DESCRIPTION OF THE DRAWINGS

The above features and advantages of the present invention will become more apparent by describing in detail preferred embodiments thereof with reference to the attached drawings in which.

DESCRIPTION OF THE PREFERRED EMBODIMENTS

Korean patent application Nos. 00-1192 and 00-1193, both filed on Jan. 11, 2000, and both entitled: "Ink-jet Head Device with Multi-Stacked PZT Actuator," are incorporated by reference herein in their entirety.

1. First Embodiment

Figure 1:
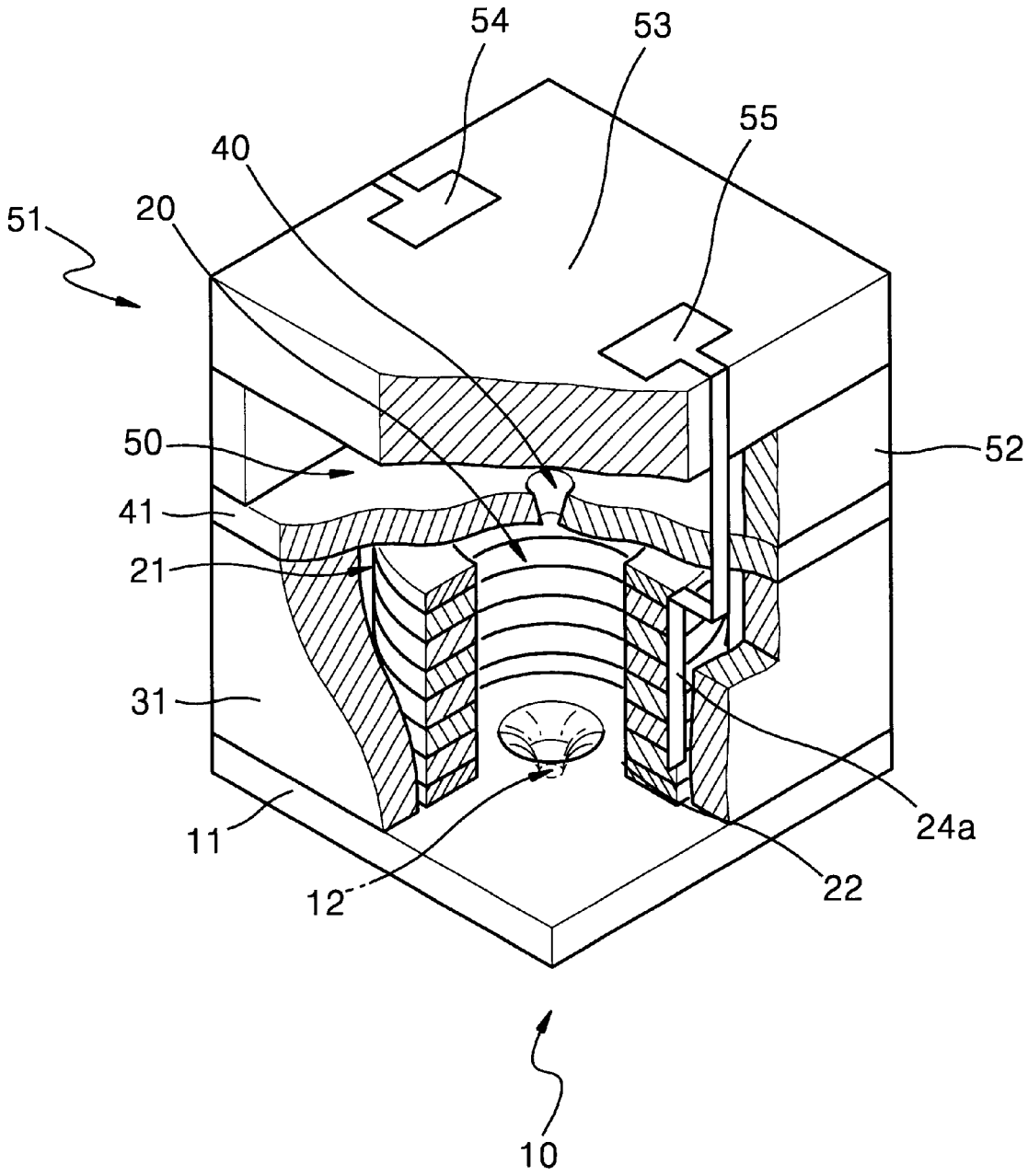
FIG. 1 is a perspective view that schematically illustrates an ink-jet head device using a multi-stacked piezoelectric actuator, according to a first embodiment of the present invention.
Figure 2:
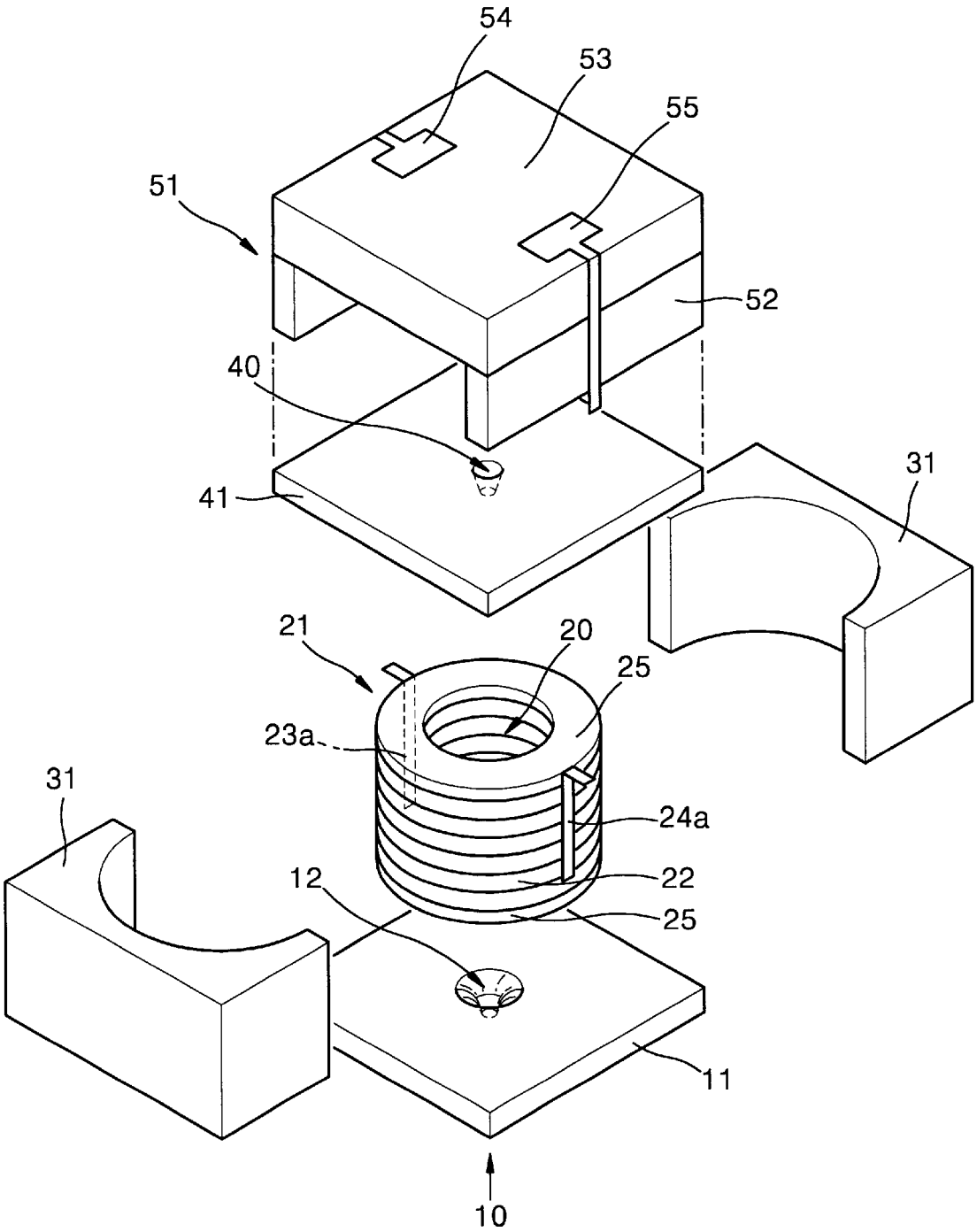
FIG. 2 is an exploded perspective view that schematically illustrates the ink-jet head device using a multi-stacked piezoelectric actuator of FIG. 1.

Referring to FIGS. 1 and 2, an ink-jet head device using a stacked piezoelectric driver according to the present invention is roughly made up of a manifold portion 51, a driving portion 21 and a nozzle portion 10.

A restrictor plate 41 is formed between the manifold portion 51 and the driving portion 21. Here, the restrictor plate 41 has at least one restrictor 40 having a through hole structure, the upper portion of which is wider than the lower portion. The nozzle portion 10 having a nozzle plate 11 on which a nozzle 12 is formed is positioned under the driving portion 21.

The manifold portion 51 includes the restrictor plate 41, manifold sidewalls 52 installed on the restrictor plate 41, and a manifold cover 53 installed on the manifold sidewalls 52. Accordingly, the manifold portion 51 provides a manifold 50 as an ink supply passage through which ink is introduced from an external ink supply source and supplied to a chamber 20 within the driving portion 21 via the restrictor plate 41 and the restrictor 40.

The restrictor 40 on the restrictor plate 41 is narrowed in the direction ink is supplied, so that it acts as a passage where ink within the manifold 50 moves to the chamber 20, and that ink from the chamber 20 in the driving portion 21 is prevented from flowing backward to the manifold 50 while ink is discharged.

Figure 3:
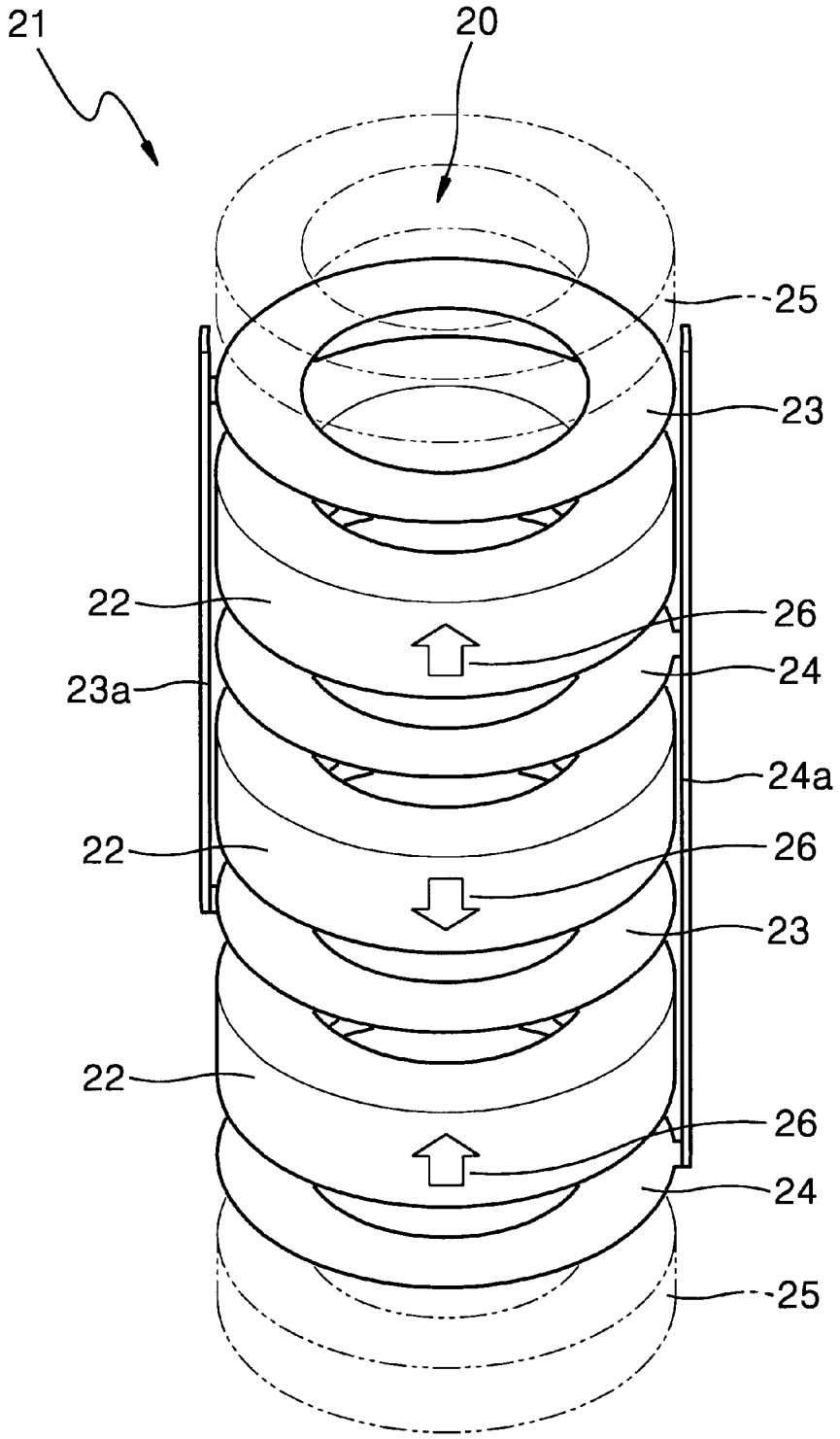
FIG. 3 is an exploded perspective view that illustrates the driving portion of the ink-jet head device using a multi-stacked piezoelectric actuator of FIG. 1.

Additionally illustrated, and as depicted in FIG. 3 in greater detail, is the driving portion 21, positioned between the manifold portion 51 and the nozzle portion 10, which includes a plurality of axially stacked ring-shaped piezoelectric bodies 22 which have a central cavity therein, common electrodes 23 and driving electrodes 24 alternately interposed between the ring-shaped piezoelectric bodies 22, and mediums 25 interposed between the restrictor plate 41 in the manifold portion 51 and the top piezoelectric body among the piezoelectric bodies 22 and between the nozzle plate 11 in the nozzle portion 10 and the lowest piezoelectric body 22. A common lead line 23*a* and a driving lead line 24*a* electrically connected to the common electrodes 23 and the driving electrodes 24, respectively, are installed on both sides of a stack of the piezoelectric bodies 22, and electrically connected to pads 54 and 55 installed on the cover 53, respectively.

In the piezoelectric body stack, the mediums 25 are formed of an elastic and deformable material, so they are elastically deformed and restored by the driving of the piezoelectric bodies 22. Accordingly, the chamber 20 in the driving portion 21 is formed by the central cavities of the mediums 25 and the piezoelectric bodies 22 between the mediums 25, and the upper and bottom portions of the chamber 20 are closed by the restrictor plate 41 and the nozzle plate 11, respectively. Supply of ink into the chamber 20 is achieved through the restrictor 40 of the restrictor plate 41, and discharge of the ink is achieved through the nozzle 12 of the nozzle plate 11. Here, the medium 25 can be installed on the side of one of the restrictor plate 41 and the nozzle plate 11, but it is preferable that the medium 25 is installed on the sides of both of the restrictor plate 41 and the nozzle plate 11. Preferably, the elasticity of the mediums 25 is smaller than that of the piezoelectric bodies 22.

In this structure, the piezoelectric bodies 22 and the mediums 25, which form the driving portion 21, can be formed in any shapes if they are hollowed, for example, in a rectangular frame shape, instead of the above-described ring-shaped ones. The internal cavities of the piezoelectric bodies 22 and the mediums 25 can have a circular shape, a rectangular shape, or a polygonal shape such as a pentagonal shape.

The driving portion 21 must have a thickness enough to have hardness that can sufficiently generate the pressure at which ink is discharged. The stack of the piezoelectric bodies 22 and the mediums 25 is protected by fixing bodies 31. Preferably, the fixing bodies 31 have higher stiffness than that of the piezoelectric bodies 22. The fixing bodies 31 are designed so that they can surround the exterior surface of the stack, and the interior surface of the fixing bodies 31 is spaced a predetermined distance apart from the exterior surface of the stack, thus providing an isolated space for coping with the deformation of the stack. The nozzle plate 11 and the restrictor plate 41 can have at least nozzle 10 and at least one restrictor 40, respectively.

Figure 4:
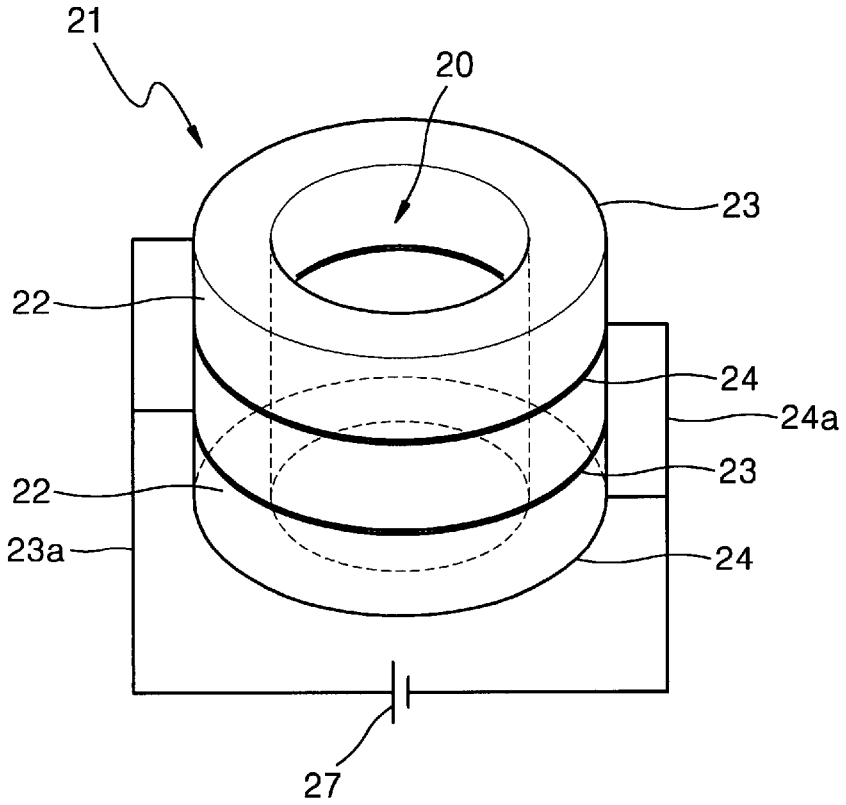
FIG. 4 is a perspective view that illustrates the driving portion of the ink-jet head device using a multi-stacked piezoelectric actuator of FIG. 1.
Figure 5:
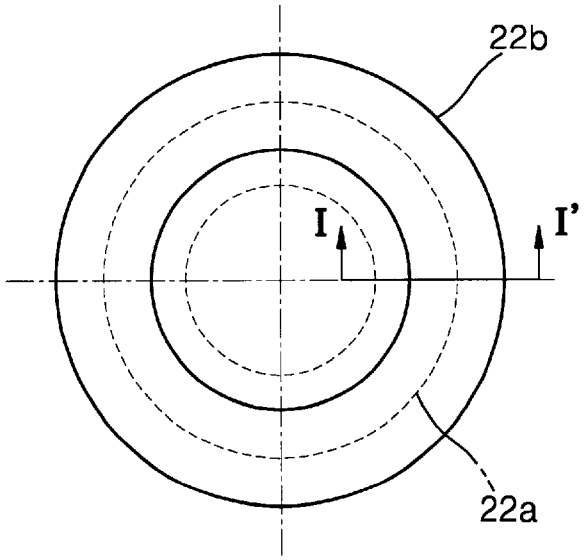
FIG. 5 is a plan view that illustrates a modification of the piezoelectric body applied to the ink-jet head device using a multi-stacked piezoelectric actuator of FIG. 1.
Figure 6:
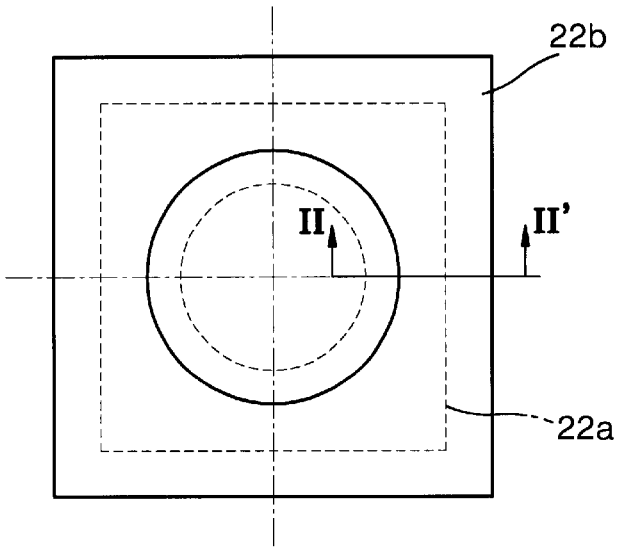
FIG. 6 is a plan view that illustrates another modification of the piezoelectric body applied to the ink-jet head device using a multi-stacked piezoelectric actuator of FIG. 1.

In the operation of the ink-jet head device according to the first embodiment of the present invention having such a structure, as shown in FIG. 4, the ink-jet head device uses the piezoelectric deformation of the piezoelectric bodies 22 caused when voltage from a power source 27 is applied to each of the piezoelectric bodies 22 via the common electrode 23 and the driving electrode 24. The deformation of the driving portion 21 causes a change in the volume of the chamber 20 within the driving portion 21, and applies a pressure to ink contained in the chamber 20, thereby discharging ink drops through the nozzle 12 of the nozzle portion 10. As shown in FIG. 3, in the driving portion 21, at least one piezoelectric body 22 is stacked in the first vertically-upward direction, and the common electrode 23 and the driving electrode 24 are alternately installed one by one on each of the stacked piezoelectric bodies. The poling direction, indicated by arrows 26, of each of the piezoelectric bodies 22 alternates the forward and backward directions of the first direction. Deformation of the piezoelectric bodies 22 caused by applied voltage is shown in FIGS. 5 and 6. FIG. 5 refers to the case when a piezoelectric body 22 is ring-shaped, and FIG. 6 refers to the case when a piezoelectric body 22 is shaped of a rectangular frame having a circular interior cavity.

Figure 7:
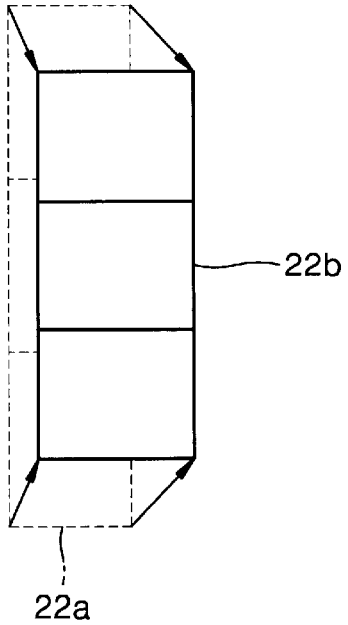
FIG. 7 is a cross-sectional view that illustrates a modification of a piezoelectric body in the driving portion of an ink-jet head device using a multi-stacked piezoelectric actuator.

In FIGS. 5 and 6, reference numeral 22*a* denotes the piezoelectric body 22, which is not deformed, and reference numeral 22*b* denotes the piezoelectric body 22, which is deformed. Here, when the piezoelectric body 22 is ring-shaped as shown in FIG. 5, its deformation is a function of only the diameter of the chamber 20. Thus, the displacement depends on a change in the diameter of the chamber 20. In contrast with the above-described deformation, FIG. 7, which is a cross-sectional view of FIG. 5 or 6 taken along line I-I' or II-II', shows deformation of the piezoelectric body where the displacement in the first direction and the displacement in a second direction perpendicular to the first direction have opposite aspects. That is, when the piezoelectric body extends in one of the first and second direction, it contracts in the other direction. In the present invention, the volume of the chamber 20 is changed using a displacement in the second direction, and the mediums 25 and the fixing bodies 31 are used to prevent a displacement in the first direction from affecting the change in the volume of the chamber 20.

Figure 8:
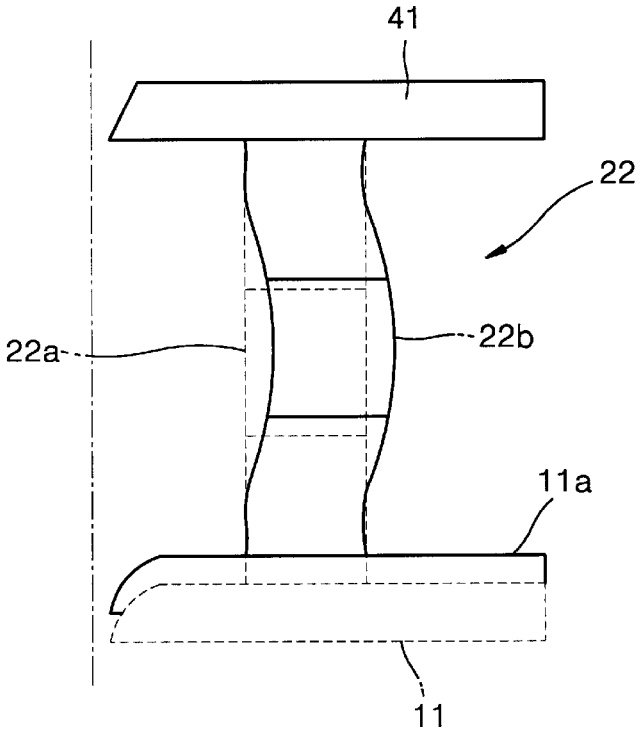
FIG. 8 is a cross-sectional view that illustrates a modification of a piezoelectric body without a medium in the driving portion of an ink-jet head device using a multi-stacked piezoelectric actuator.

FIG. 8 shows deformation of a stack of piezoelectric bodies 22, which are connected directly to the restrictor plate 41 and the nozzle plate 11 without the mediums 25 and the fixing bodies 31, when voltage is applied. In this structure, since the upper and bottom ends of the stack of the piezoelectric bodies 22 are directly connected to the restrictor plate 41 and the nozzle plate 11, the connected portions of the piezoelectric body stack to the restrictor plate 41 and the nozzle plate 11 are not deformed in the second direction, that is, in the radial direction. However, the stack of the piezoelectric bodies 22 is deformed in the first direction, thus moving the nozzle plate 11 in the first direction as shown in reference numeral 11*a*. The deformation 11*a* acts in opposite to a change in the volume of the chamber 20 due to a deformation 22*b* in the second direction that occurs in the middle place between the restrictor plate 41 and the nozzle plate 11. That is, a valid volume change is obtained by the difference between the deformation values 11*a* and 22*b*, thus degrading the performance of driving.

Figure 9:
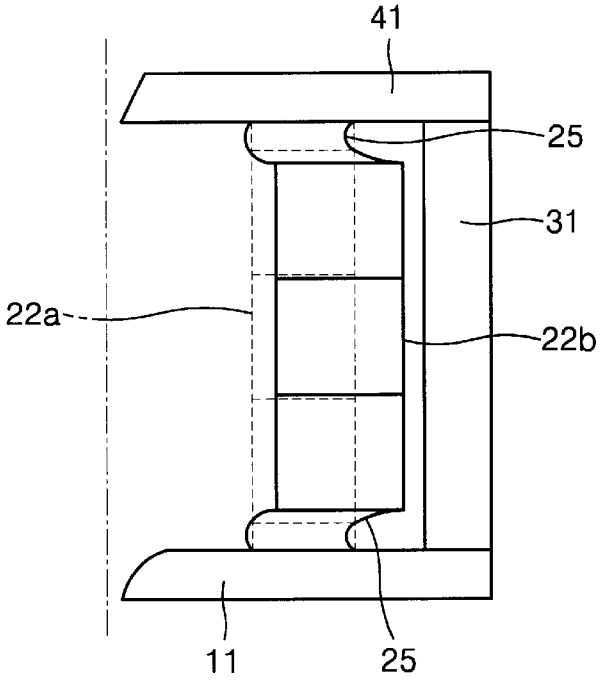
FIG. 9 is a plan view that illustrates a modification of a medium not optimized upon deformation of a piezoelectric body in the ink-jet head device using a multi-stacked piezoelectric actuator of FIG. 1.
Figure 10:
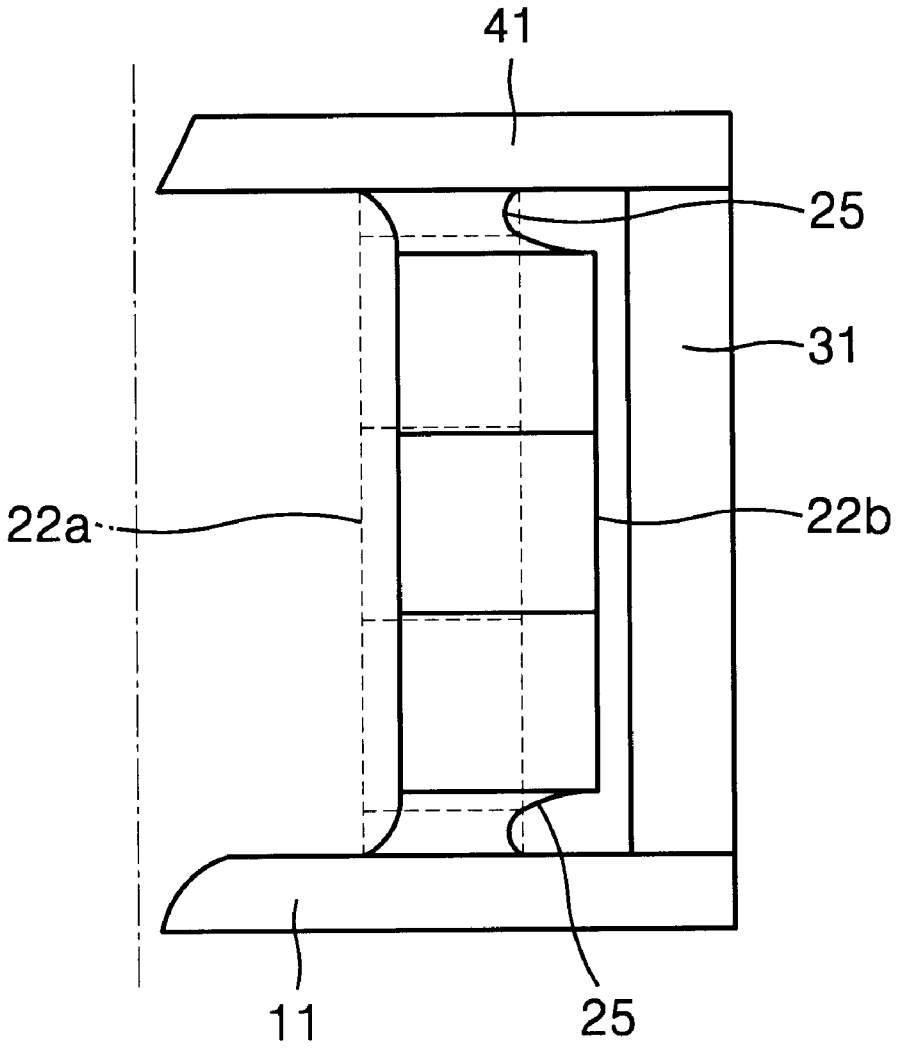
FIG. 10 is a plan view that illustrates a modification of a medium optimized upon deformation of a piezoelectric body in the ink-jet head device using a multi-stacked piezoelectric actuator of FIG. 1.

FIGS. 9 and 10 show deformation of a piezoelectric body stack provided with the mediums 25 and the fixing bodies 31, when the piezoelectric body 22 operates in consideration of the internal pressure of ink. Reference numeral 22*a* denotes a non-deformed piezoelectric body, and reference numeral 22*b* denotes a deformed piezoelectric body. FIG. 9 shows deformation of the piezoelectric body 22 when the cross-section of the mediums 25 is not optimally deformed, and FIG. 10 shows preferable deformation of the piezoelectric body 22 when the cross-section of the mediums 25 is optimally deformed. The preferable deformation of the mediums 25 depends on the elasticity coefficient of the mediums 25 and the thickness thereof in the stacking direction. When the mediums 25 have a similar material property value to rubber, the deformation of the piezoelectric body efficiently acts on a change in the volume of the chamber 20.

2. Second Embodiment

Figure 11:
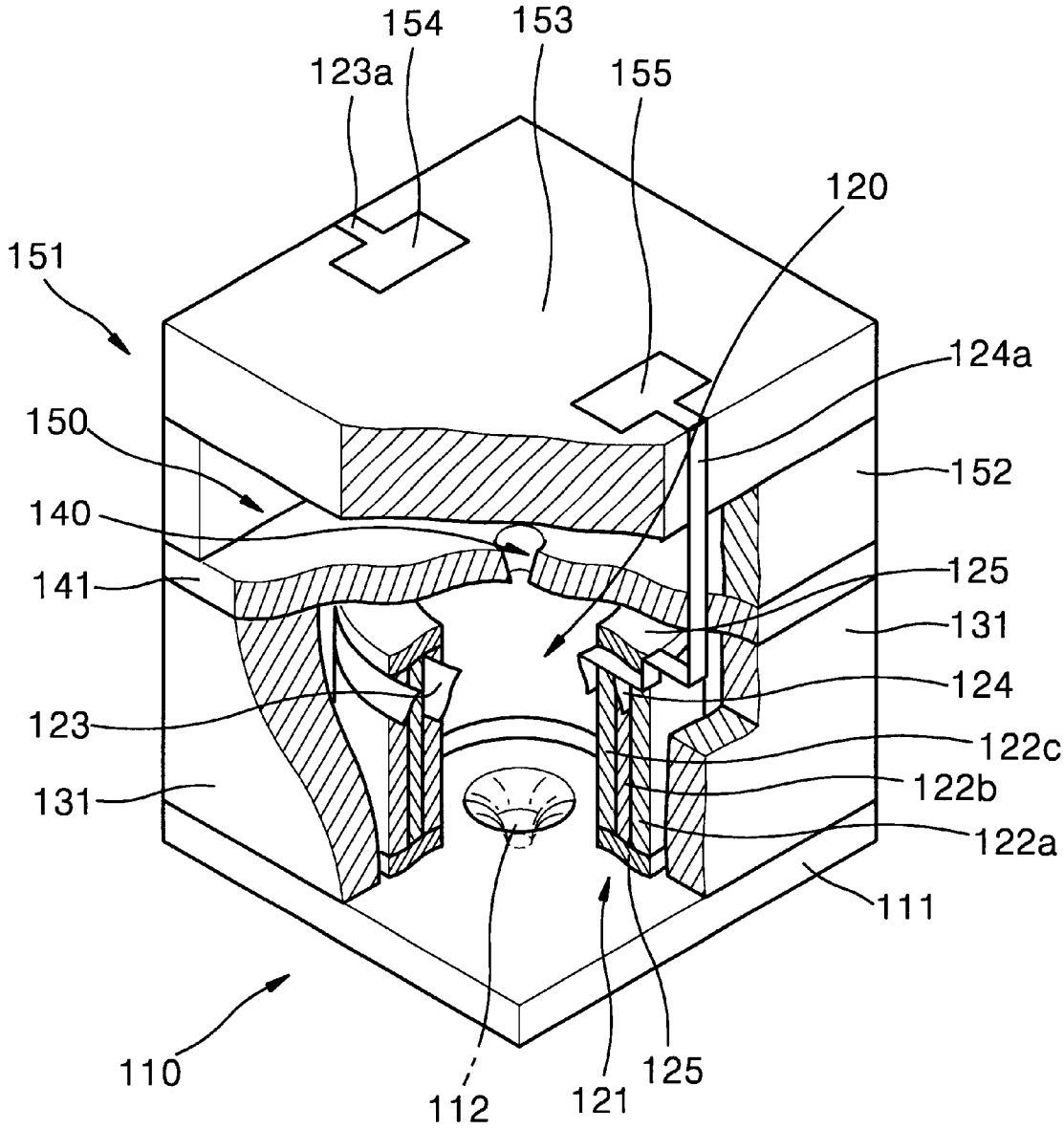
FIG. 11 is a perspective view that schematically illustrates an ink-jet head device using a multi-stacked ring-type piezoelectric actuator, according to a second embodiment of the present invention.
Figure 12:
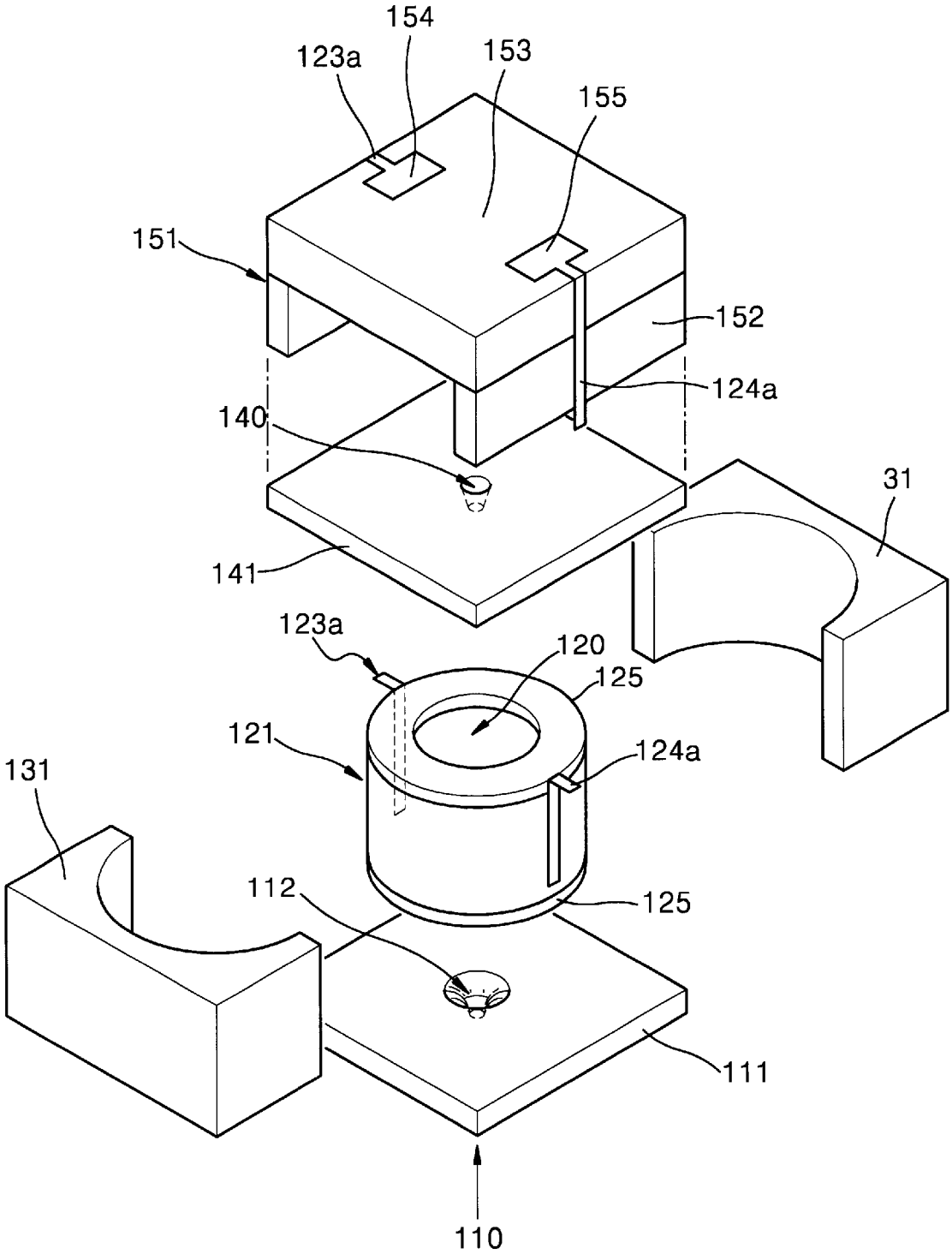
FIG. 12 is an exploded perspective view that schematically illustrates the ink-jet head device using a multi-stacked ring-type piezoelectric actuator of FIG. 11.

Referring to FIGS. 11 and 12, an ink-jet head device using a radially stacked ring-shaped piezoelectric actuator according to the present invention is roughly made up of a manifold portion 151, a driving portion 121 and a nozzle portion 110. A restrictor plate 141 on which at least one restrictor 140 having a through hole that is narrowed downward is formed is installed between the manifold portion 151 and the driving portion 121. The nozzle portion 110 having a nozzle plate 111 on which a nozzle 112 is formed is placed below the driving portion 121.

The manifold portion 151 includes the restrictor plate 141, manifold sidewalls 152 installed on the restrictor plate 141, and a manifold cover 153 supported by the manifold sidewalls 152, so that it provides a manifold 150 as an ink supply passage through which ink is introduced from an external ink supply source and supplied to a chamber 120 within the driving portion 121 via the restrictor plate 141 and the restrictor 140.

The restrictor 140 on the restrictor plate 141 is narrowed in the direction ink is supplied, so that it acts as a passage where ink within the manifold 150 moves to the chamber 120, and that ink from the chamber 120 in the driving portion 121 is prevented from flowing backward to the manifold 150 while ink is discharged.

Figure 13:
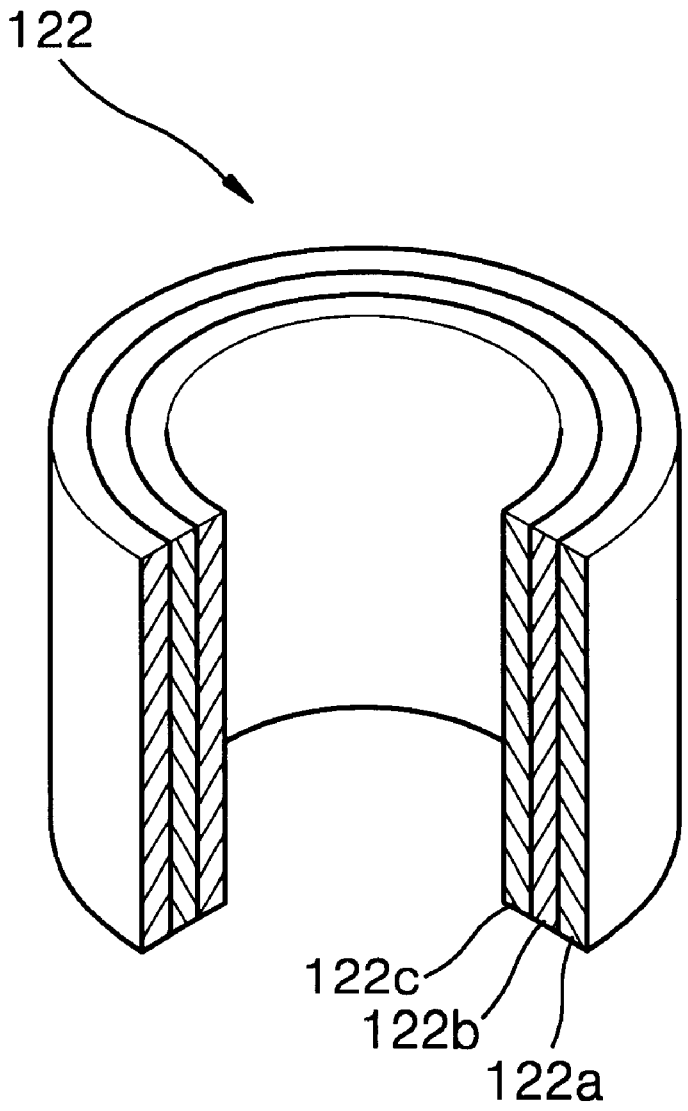
FIG. 13 is an extracted perspective view that illustrates a piezoelectric structure in the ink-jet head device using a multi-stacked ring-type piezoelectric actuator of FIG. 11.

Additionally illustrated, and as depicted in FIG. 13 in greater detail, is the driving portion 121 positioned between the manifold portion 151 and the nozzle portion 110 includes a cylindrical piezoelectric structure 122 in which a plurality of cylindrical piezoelectric bodies 122*a,* 122*b* and 122*c* each having a predetermined length in the first direction are stacked in the second direction (radial direction) perpendicular to the first direction. Also, as shown in FIG. 11, a driving electrode 124 and a common electrode 123 are alternately interposed between the cylindrical piezoelectric bodies 122*a* and 122*b* of the cylindrical piezoelectric structure 122, and between the cylindrical piezoelectric bodies 122*b* and 122*c,* respectively. Mediums 125 are interposed one by one between the restrictor plate 141 in the manifold portion 151 and the top surface of the piezoelectric body structure 122, which is viewed in the first direction, and between the nozzle plate 111 in the nozzle portion 110 and the bottom surface of the piezoelectric body structure 122. The common electrode 123 and the driving electrode 124 interposed between the cylindrical piezoelectric bodies 122*a,* 122*b* and 122*c* are electrically connected to the pads 154 and 155 installed on the manifold cover 153, respectively, via a common lead line 123*a* and a driving lead line 124*a,* respectively.

In the piezoelectric body structure 122, the mediums 125 are formed of an elastic and deformable material, so they are elastically deformed and restored by the driving of the piezoelectric body structure 122. Accordingly, the chamber 120 in the driving portion 121 is given by the central cavity of the innermost piezoelectric body 122*c,* and the top and bottom of the chamber 20 are closed by the restrictor plate 141 and the nozzle plate 111, respectively. Supply of ink into the chamber 120 is achieved through the restrictor 140 of the restrictor plate 141, and discharge of the ink is achieved through the nozzle 112 of the nozzle plate 111. Preferably, the elasticity of each of the mediums 125 is smaller than that of each of the piezoelectric bodies 122*a,* 122*b* and 122*c.*

In this structure, the piezoelectric body structure 122 and the mediums 125, which constitute the driving portion 121, can be formed in any shapes if they are hollowed, for example, in a rectangular frame shape, instead of the above-described ring-shaped structure. The internal cavities of the piezoelectric body structure 122 and the mediums 125 can have a circular shape, a rectangular shape, or a polygonal shape such as a pentagonal shape.

The driving portion 121 must have a thickness enough to have hardness that can sufficiently generate the pressure at which ink is discharged. The driving portion 121 formed by the piezoelectric body structure 122 and the mediums 125 is protected by a fixing body 131. Preferably, the fixing body 131 has a higher elasticity than those of the piezoelectric bodies 122*a,* 122*b* and 122*c.* The interior surface of the fixing body 131 keeps a predetermined distance from the exterior surface of an outermost piezoelectric body 122*a* of the piezoelectric structure 122, thus providing an isolated space for coping with the deformation of the piezoelectric body structure 122. The nozzle plate 111 and the restrictor plate 141 can have at least nozzle 110 and at least one restrictor 140, respectively.

3. Third Embodiment

This embodiment is the same as the second embodiment except that mediums are installed on the interior surface of a multi-layered piezoelectric body structure.

Figure 14:
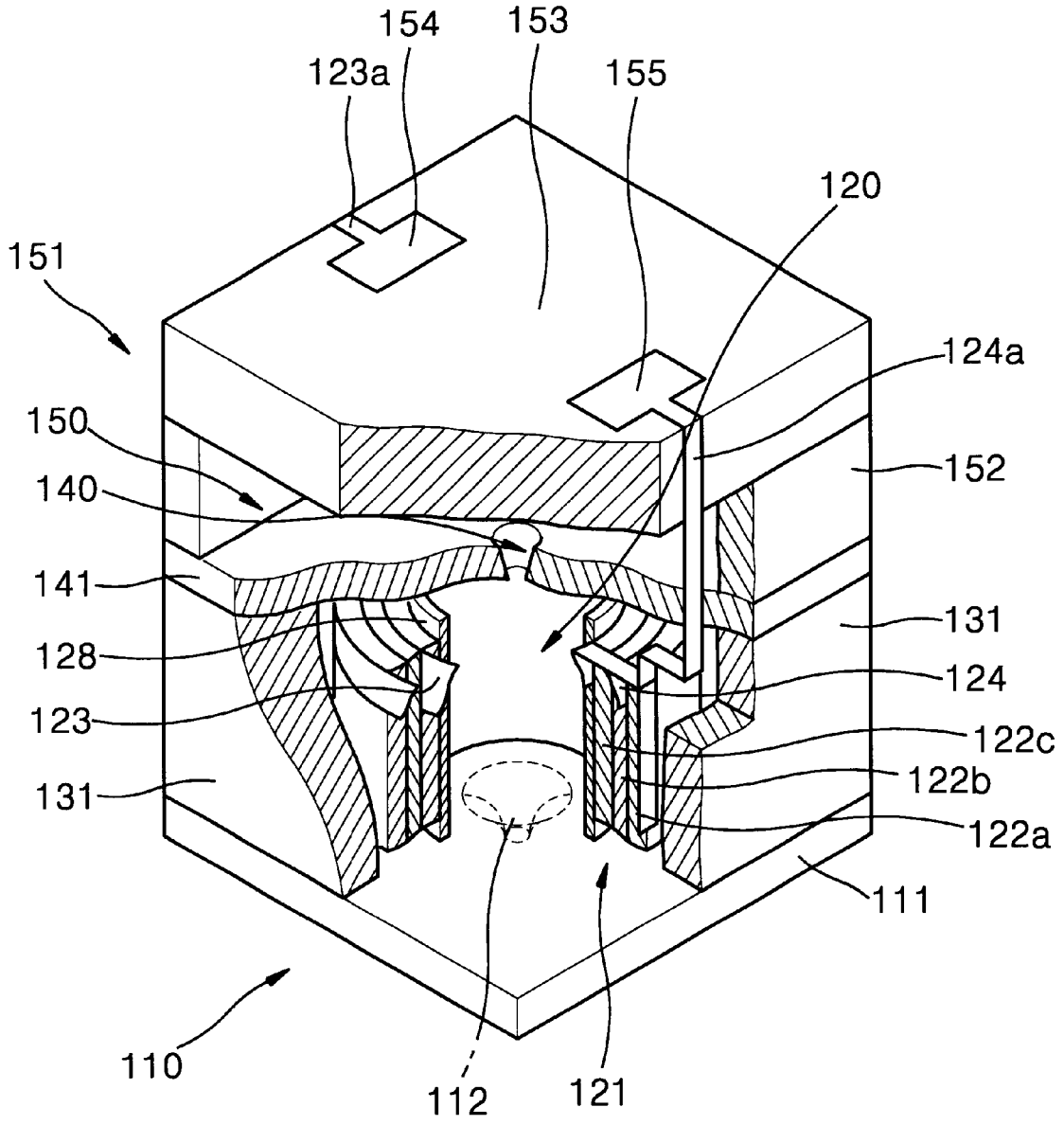
FIG. 14 is a perspective view that schematically illustrates an ink-jet head device using a multi-stacked ring-type piezoelectric actuator, according to a third embodiment of the present invention.

That is, as shown in FIG. 14, a cylindrical piezoelectric body structure 122 is separated from the restrictor plate 141 and the nozzle plate 111, and a cylindrical medium 128 is installed on the inner circumferential surface of the cylindrical piezoelectric body structure 122. The top and bottom portions of the cylindrical medium 128 are connected to the restrictor plate 141 and the nozzle plate 111. Thus, the chamber 120 is given by the cylindrical medium 128.

Figure 15:
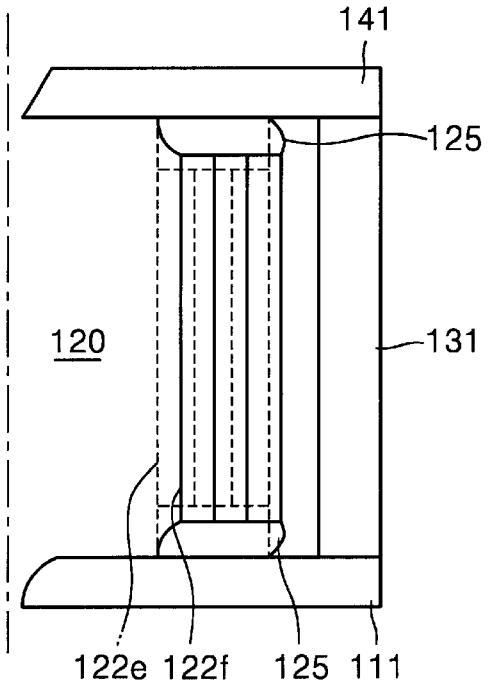
FIG. 15 is a cross-sectional view that illustrates a modification to the piezoelectric structure in the ink-jet head device of FIG. 11.
Figure 16:
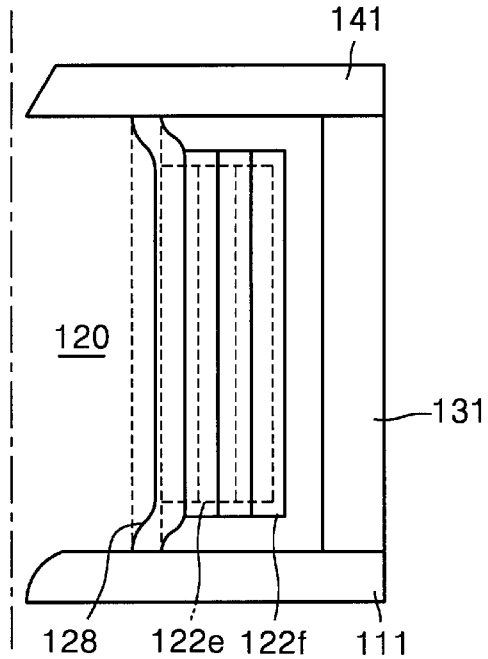
FIG. 16 is a cross-sectional view that illustrates a modification to the piezoelectric structure in the ink-jet head device of FIG. 14.

The operation of the third embodiment according to the present invention having such a structure will now be described referring to FIGS. 15 through 17. FIG. 15 shows a change in the volume of the chamber 120 due to deformation of the cylindrical medium 128 according to the second embodiment, and FIG. 16 shows a change in the volume of the chamber 120 due to deformation of the piezoelectric body structure 122 according to the third embodiment. In FIGS. 15 and 16, reference numeral 122*e* denotes a non-deformed piezoelectric body structure 122, and reference numeral 122*f* denotes a deformed piezoelectric body structure 122.

Figure 17:
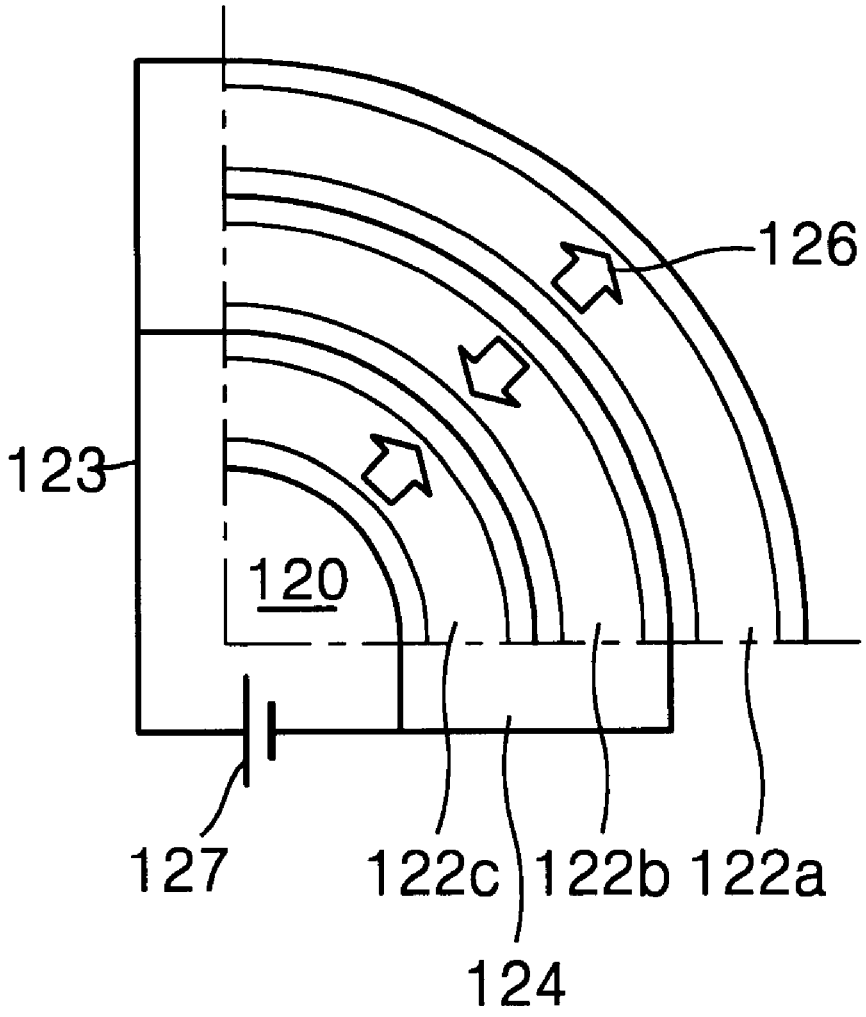
FIG. 17 is a cross-sectional view that illustrates the polarization of each piezoelectric body in the piezoelectric structure in the ink-jet head device using a multi-stacked ring-type piezoelectric actuator, according to the present invention.

Referring to FIG. 17, when voltage is applied from a power source 127 to each of the piezoelectric bodies 122*a,* 122*b* and 122*c* of the piezoelectric body structure 122 via the common electrode 124 and the driving electrode 123, the volume of the chamber 120 is changed. When the internal pressure of the chamber 120 due to a reduction in its volume increases, ink contained in the chamber 120 is pressurized, thereby discharging ink drops via the nozzle 112 of the nozzle portion 110. When the internal pressure of the chamber 120 due to an increase in its volume decreases, ink contained in the chamber 120 is adsorbed into the chamber via the restrictor 140.

As described above, the piezoelectric bodies 122 in the driving portion 121 are stacked in the second direction (radial direction), and the common electrode 123 and the driving electrode 124 are alternately interposed between the stacked piezoelectric bodies 122. Thus, the poling directions, indicated by arrows 126, of the piezoelectric bodies 122 alternate the forward and backward directions based on the second direction. Accordingly, when voltage is applied, the piezoelectric body structure 122 is deformed as shown in FIGS. 15 and 16, leading to an increase in the volume of the chamber 120.

As shown in FIG. 15, this deformation is a function of the diameter of the chamber 120 and the piezoelectric bodies 122*a,* 122*b* and 122*c,* and a generated pressure also varies. FIGS. 15 and 16 show deformation of the piezoelectric body structure 122 where the displacement of the piezoelectric bodies 122*a,* 122*b* and 122*c* in the first direction and the displacement thereof in a second direction perpendicular to the first direction have the same aspect. That is, when the piezoelectric bodies 122*a,* 122*b* and 122*c* extend in the first direction, they also extend in the second direction.

This means that the volume of the chamber 120 can vary in both the first and second directions. However, in the present invention, the volume of the chamber 120 is changed using the displacement of the piezoelectric bodies 122*a,* 122*b* and 122*c* in the second direction (radial direction). On the other hand, the mediums 125 and the fixing body 131 are used to prevent the displacement of the piezoelectric bodies 122*a,* 122*b* and 122*c* in the first direction from affecting the change in the volume of the chamber 120.

The preferable deformations of the mediums 125 and 128 depend on their elasticity coefficients and their thicknesses in the stacking direction. When the mediums 125 and 128 have similar material properties to rubber, the deformation of the piezoelectric body structure 122 efficiently acts on a change in the volume of the chamber 120.

In the first type of the present invention, a chamber is given by the circular or rectangular cavities of the piezoelectric bodies, and the cavities of piezoelectric bodies stacked in multiple layers inserting electrodes between them as described above are applied as the chamber for containing ink. Accordingly, the first type of the present invention can solve the problems of a bending or pushing ink-jet head device using a vibrating plate, and reduce the area of the ink head device. The deformation of piezoelectric bodies to increase the volume of the chamber depends on only the size of the chamber, which is the interior space of the stacked piezoelectric bodies. The pressure given to ink during driving of the ink head device depends on only the radial thickness of each of the piezoelectric bodies. Therefore, the displacement of the piezoelectric bodies and the pressure given to the ink can increase independently. Also, stacking of piezoelectric bodies enables the volume of the chamber to be greatly changed even at low voltage.

In the second type of the present invention, a chamber is given by the circular or rectangular cavity within the piezoelectric body structure formed with piezoelectric bodies in multiple layers, and the central cavity of the piezoelectric body structure is applied as the chamber for containing ink. Accordingly, the second type of the present invention can solve the problems of a bending or pushing ink-jet head device using a vibrating plate. Also, the multi-layered piezoelectric body structure is polarized in the second direction, and a great force and a great deformation can be generated even at a low driving voltage by the use of a displacement due to a piezoelectric constant in the second direction, leading to a reduction in the area of the ink-jet head device. The deformation of piezoelectric bodies to increase the volume of the chamber depends on only the size of the chamber, which is the interior space of the stacked piezoelectric bodies. The pressure given to ink during driving of the ink head device depends on only the thickness of each of the piezoelectric bodies. Therefore, the displacement of the piezoelectric bodies and the pressure given to the ink can increase independently.

Although the invention has been described with reference to particular embodiments of the present invention, it will be apparent to one of ordinary skill in the art that modifications of the described embodiments may be made without departing from the spirit and scope of the invention.

What is claimed is:

1. An ink-jet head device using a piezoelectric actuator, comprising:

a nozzle plate on which at least one nozzle for discharging ink is formed;

a manifold portion having a restrictor plate on which at least one restrictor is formed;

a plurality of piezoelectric bodies vertically stacked in multiple layers and interposed between the nozzle plate and the manifold portion to form a chamber for containing ink, each of the piezoelectric bodies having a cavity at the center;

a plurality of common electrodes and a plurality of driving electrodes alternately interposed one by one between each adjacent one of the plurality of piezoelectric bodies;

a common lead line and a driving line electrically connected to the plurality of the common electrodes and the plurality of driving electrodes, respectively, for supplying a voltage to the plurality of piezoelectric bodies to cause deformation thereof; and a plurality of mediums interposed at least between the restrictor plate and a piezoelectric body adjacent to the restrictor plate, and between the nozzle plate and a piezoelectric body adjacent to the nozzle plate, the plurality of mediums deformed corresponding to deformation of the plurality of piezoelectric bodies.

2. The ink-jet head device using a piezoelectric actuator as claimed in claim 1, further comprising a fixing body between the restrictor plate and the nozzle plate, which surrounds the plurality of piezoelectric bodies separated by a predetermined distance and providing an isolation space.

3. The ink-jet head device using a piezoelectric actuator as claimed in claim 2, wherein the fixing body has a higher elastic coefficient than the plurality of piezoelectric bodies.

4. The ink-jet head device using a piezoelectric actuator as claimed in claim 2, wherein the diameter of the nozzle gradually decreases in the direction in which ink is discharged.

5. The ink-jet head device using a piezoelectric actuator as claimed in claim 2, wherein the restrictor plate has at least two sides and wherein the manifold portion further comprises:

a plurality of sidewalls installed on each side of the restrictor plate; and a manifold cover for covering a space over the restrictor plate defined by the plurality of sidewalls.

6. The ink-jet head device using a piezoelectric actuator as claimed in claim 2, wherein a poling direction of one of the plurality of piezoelectric bodies is opposite to the poling direction of an adjacent one of the plurality of piezoelectric bodies.

7. The ink-jet head device using a piezoelectric actuator as claimed in claim 2, wherein a elasticity coefficient of the plurality of mediums is smaller than the elasticity coefficient of each of the plurality of piezoelectric bodies.

8. The ink-jet head device using a piezoelectric actuator as claimed in claim 1, wherein the diameter of the nozzle gradually decreases in the direction in which ink is discharged.

9. The ink-jet head device using a piezoelectric actuator as claimed in claim 1, wherein the restrictor plate has at least two sides and wherein the manifold portion further comprises:

a plurality of sidewalls installed on each side of the restrictor plate; and a manifold cover for covering a space over the restrictor plate defined by the plurality of sidewalls.

10. The ink-jet head device using a piezoelectric actuator as claimed in claim 1, wherein a poling direction of one of the plurality of piezoelectric bodies is opposite to the poling direction of an adjacent one of the plurality of piezoelectric bodies.

11. The ink-jet head device using a piezoelectric actuator as claimed in claim 1, wherein a elasticity coefficient of the plurality of mediums is smaller than the elasticity coefficient of each of the plurality of piezoelectric bodies.

12. The ink-jet head device using a piezoelectric actuator as claimed in claim 1, wherein the plurality of piezoelectric bodies are ring-like.

13. The ink-jet head device using a piezoelectric actuator as claimed in claim 1, wherein the plurality of piezoelectric bodies are rectangular in shape having a circular interior cavity.

14. An ink-jet head device using a piezoelectric actuator, comprising:

a nozzle plate on which at least one nozzle for discharging ink is formed;

a manifold portion having a restrictor plate on which at least one restrictor is formed;

a piezoelectric body structure interposed between the nozzle plate and the manifold portion, in which a plurality of cylindrical piezoelectric bodies of increasing diameter are aligned radially to provide a chamber for containing ink;

a plurality of common electrodes and a plurality of driving electrodes alternately interposed one by one between each adjacent one of the plurality of piezoelectric bodies;

a common lead line and a driving line electrically connected to the plurality of the common electrodes and the plurality of driving electrodes, respectively, for supplying a voltage to the plurality of cylindrical piezoelectric bodies to cause deformation thereof; and a plurality of mediums interposed between the restrictor plate and one end of the piezoelectric body structure adjacent to the restrictor plate, and between the nozzle plate and the other end of the piezoelectric body structure adjacent to the nozzle plate, the plurality of mediums deformed corresponding to deformation of the plurality of cylindrical piezoelectric bodies.

15. The ink-jet head device using a piezoelectric actuator as claimed in claim 14, wherein the shape of each of the plurality of piezoelectric bodies is chosen from the group consisting of ring-shaped and rectangular shaped with a circular interior cavity.

16. The ink-jet head device using a piezoelectric actuator as claimed in claim 14, wherein the shape of each of the plurality of mediums and the shape of an internal cavity of each of the plurality of piezoelectric bodies is chosen the group consisting of circular, rectangular, and polygonal.

17. The ink-jet head device using a piezoelectric actuator as claimed in claim 14, wherein the diameter of the nozzle gradually decreases in the direction in which ink is discharged.

18. The ink-jet head device using a piezoelectric actuator as claimed in claim 14, wherein the restrictor plate has at least two sides and wherein the manifold portion further comprises:

a plurality of sidewalls installed on each side of the restrictor plate; and a manifold cover for covering a space over the restrictor plate defined by the plurality of sidewalls.

19. The ink-jet head device using a piezoelectric actuator as claimed in claim 14, wherein the poling direction of each one of the plurality of piezoelectric bodies is opposite to the poling direction of an adjacent one of the plurality of piezoelectric bodies.

20. The ink-jet head device using a piezoelectric actuator as claimed in claim 14, wherein the elasticity coefficient of the plurality of mediums is smaller the elasticity coefficient of the plurality of piezoelectric bodies.

21. The ink-jet head device using a piezoelectric actuator as claimed in claim 14, further comprising a fixing body between the restrictor plate and the nozzle plate, which surrounds the piezoelectric body stack separated by a predetermined distance and providing an isolation space.

22. The ink-jet head device using a piezoelectric actuator as claimed in claim 21, wherein the fixing body has a higher elastic coefficient than the elastic coefficient of the plurality of piezoelectric bodies.

23. An ink-jet head device using a piezoelectric actuator, comprising:

a nozzle plate on which at least one nozzle for discharging ink is formed;

a manifold portion having a restrictor plate on which at least one restrictor is formed;

a cylindrical medium between the nozzle plate and the manifold portion, and provides a chamber for containing ink;

a piezoelectric body structure installed around the cylindrical medium and separated from the nozzle plate and the manifold portion, in which a plurality of cylindrical piezoelectric bodies of increasing diameter are aligned radially;

a plurality of common electrodes and a plurality of driving electrodes alternately interposed one by one between each adjacent one of the plurality of piezoelectric bodies; and a common lead line and a driving line electrically connected to the plurality of the common electrodes and the plurality of driving electrodes, respectively, for supplying a voltage to the plurality of piezoelectric bodies to cause deformation thereof.

24. The ink-jet head device using a piezoelectric actuator as claimed in claim 23, wherein the diameter of the nozzle gradually decreases in the direction in which ink is discharged.

25. The ink-jet head device using a piezoelectric actuator as claimed in claim 23, wherein the restrictor plate has at least two sides and wherein the manifold portion comprises:

a plurality of sidewalls installed on each side of the restrictor plate; and a manifold cover for covering a space over the restrictor plate defined by the sidewalls.

26. The ink-jet head device using a piezoelectric actuator as claimed in claim 23, wherein the poling direction of one of the plurality of piezoelectric bodies is opposite to the poling direction of an adjacent one of the plurality of piezoelectric bodies.

27. The ink-jet head device using a piezoelectric actuator as claimed in claim 23, wherein the elasticity coefficient of the medium is smaller than the elasticity coefficient of the plurality of piezoelectric bodies.

28. The ink-jet head device using a piezoelectric actuator as claimed in claim 23, further comprising a fixing body between the restrictor plate and the nozzle plate, which surrounds the piezoelectric body stack separated by a predetermined distance and provides an isolation space.

29. The ink-jet head device using a piezoelectric actuator as claimed in claim 28, wherein the fixing body has a higher elastic coefficient than the piezoelectric bodies.

* * * * *